US007127852B1

(12) United States Patent
Dressler

(10) Patent No.: US 7,127,852 B1
(45) Date of Patent: Oct. 31, 2006

(54) MOUNTING BRACKET AND SNOW GUARD FOR RAISED SEAM ROOF

(75) Inventor: Robert D. Dressler, Mechanicsburg, PA (US)

(73) Assignee: Amerimax Home Products, Inc., Lancaster, PA (US)

( * ) Notice: Subject to any disclaimer, the term of this patent is extended or adjusted under 35 U.S.C. 154(b) by 26 days.

(21) Appl. No.: 10/665,775

(22) Filed: Sep. 17, 2003

(51) Int. Cl.
*E04D 13/00* (2006.01)

(52) U.S. Cl. ..... 52/24; 52/25; 248/224.51

(58) Field of Classification Search ..... 52/24, 52/25, 545; 248/224.51; 403/381
See application file for complete search history.

(56) References Cited

U.S. PATENT DOCUMENTS

| | | | | |
|---|---|---|---|---|
| 97,316 | A | 11/1869 | Rogers | |
| 473,512 | A | 4/1892 | Laird | |
| 1,877,781 | A * | 9/1932 | Akerlund | 248/72 |
| 2,079,768 | A | 5/1937 | Levow | |
| 2,320,776 | A * | 6/1943 | Gorton | 409/235 |
| 5,222,340 | A * | 6/1993 | Bellem | 52/463 |
| 5,228,248 | A * | 7/1993 | Haddock | 52/25 |
| D364,338 | S | 11/1995 | Cline | |
| 5,522,185 | A | 6/1996 | Cline | |
| D372,421 | S | 8/1996 | Cline | |
| 5,613,328 | A * | 3/1997 | Alley | 52/25 |
| 5,732,513 | A * | 3/1998 | Alley | 52/25 |
| 6,256,934 | B1 * | 7/2001 | Alley | 52/25 |
| 6,453,623 | B1 * | 9/2002 | Nelson et al. | 52/24 |
| 6,536,166 | B1 * | 3/2003 | Alley | 52/25 |
| 6,647,671 | B1 * | 11/2003 | Alley | 52/25 |

* cited by examiner

*Primary Examiner*—Basil Katcheves
(74) *Attorney, Agent, or Firm*—Miller Law Group, PLLC

(57) ABSTRACT

A mounting bracket attaches implements and other devices to the top surface of an inclined raised seam roof structure. The mounting bracket is formed with a body portion defining a wide cavity between opposing side walls to accommodate a variety of different sizes and shapes of raised seam configurations. A pair of opposing clamping jaws are disposed within the body cavity. One clamping jaw is fixed to a side of the body member, while the other clamping jaw is movably mounted to a threaded fastener that advances the movable clamping jaw toward the fixed clamping jaw and grip a raised seam structure therebetween. The body portion has a wedge-shaped receptacle on the top surface to mount devices such as a snow guard, which can be locked into place on the mounting bracket by a threaded fastener.

22 Claims, 8 Drawing Sheets

Fig. 3
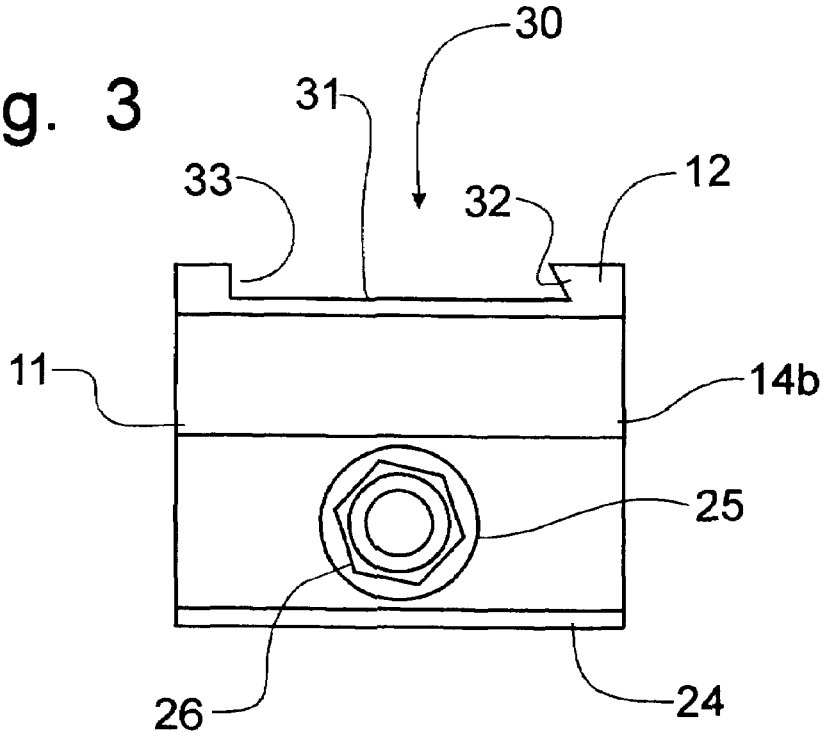
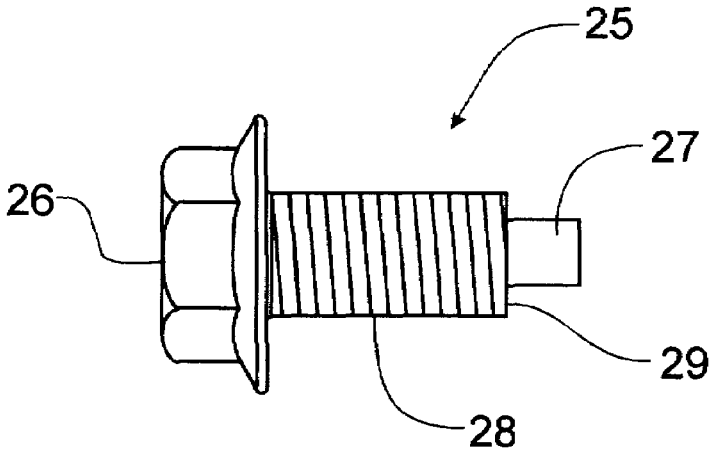
Fig. 4
Fig. 4A
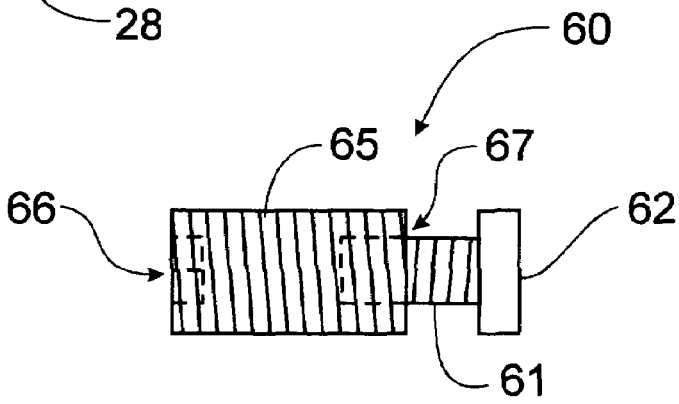

40
48
45
14a
43
39
42
48
10
11
17
17

40
42
50
10
57
59
55
15
48
13
20
43
60
57
16
16

40
42
48
45
10
11
60
48
30
14b
43
66

MOUNTING BRACKET AND SNOW GUARD FOR RAISED SEAM ROOF

BACKGROUND OF THE INVENTION

This invention relates generally to a snow guard for mounting on a raised seam roof and, more particularly, to a mounting bracket that engages the raised seam portion of a roof structure to support a snow guard thereon.

Raised seam roofs are formed with panels manufactured from sheet metal or other suitable building materials with a flat panel that runs from the peak of the roof to the lower edge thereof. These panels are joined together by a formed edges that projects upwardly above the flat surface of the panel. The formed edges of adjacent panels are interlocked to fix the panels together in a sealed seam that is raised above the otherwise planar surface of the panels. Clips can be connected to the raised seams to tie into the frame structure of the building immediately beneath the seams, thereby fixing the roofing material which the panels form to the building. The sealed seams and the lower planar surfaces of the panels provide a watertight barrier against moisture provided that the panels, including the raised seams, are not punctured. Attaching devices to a raised seam roof without puncturing the panels or the sealed raised seams is a problem that has been appreciated for many years.

Raised seam roofs with the planar surfaces running from the roof peak to the roof edge do not retain snow on the roof surface as any accumulated snow tends to slide downwardly along the planar surfaces, particularly after the snow has partially melted to form a moisture layer between the roof panels and the accumulated snow. One of the most frequently needed devices to be attached to raised seam roofs is a snow guard which is operable to restrict the movement of accumulated snow off the roof panels. Other devices are often needed to be mounted on the roof, such as lightening rods, antennas, or support structures for both people and other apparatus such as air conditioners, etc. A device that can engage the raised seam roof to permit such devices to be mounted thereon without causing the roof or the raised seam thereof to be perforated has been contemplated for many years.

One of the early mechanisms for mounting devices on raised seam roofs can be found in U.S. Pat. No. 1,330,309, issued to R. T. Dixon on Feb. 10, 1920. The Dixon mechanism includes an elongated channel member having a cavity formed therein to receive the raised seam portion of the roof panel structure. A mounting bolt is received within a transverse threaded bore to engage the raised seam portion within the cavity of the channel member to deform the raised seam into a formed pocket, thereby affixing the channel member to the raised seam portion of the roof. A board rest member is formed as part of the channel member to permit the detachable mounting of devices, such as a snow guard, to the channel member.

A number of patents, including U.S. Pat. No. 5,228,248; U.S. Pat. No. 5,483,772; U.S. Pat. No. 5,491,931; U.S. Pat. No. 5,983,588; and U.S. Pat. No. 6,164,033 were issued to Robert M. M. Haddock for a mounting member that, like the Dixon patent, is affixed to the raised seam portion of a roof structure without puncturing the surface of the roof panels by a fastener that engages and deforms the raised seam portion. The Haddock mounting members typically require two fasteners for stability and are formed with cavities extending through the body of the mounting member to attach devices, such as a snow fence or decorative attachments, to the mounting member.

U.S. Pat. No. 5,282,340; U.S. Pat. No. D364,338; U.S. Pat. No. D372,421; and U.S. Pat. No. 5,522,185 were issued to Roger M. Cline, et al. for various configurations of snow guards which are formed to be mounted on the raised seam portion of a roof structure. Like the Dixon and Haddock patents, the mounting of the snow guard involves the utilization of a fastener that is threaded into a body portion of the snow guard to engage and deform the raised seam portion of the roof structure to affix the snow guard to the roof. The snow guard structure includes a transversely extending body manufactured in a formed shape to present an esthetically pleasing device to be exposed on the surface of the roof.

U.S. Pat. No. 884,850, issued on Apr. 14, 1908, to F. A. Peter, is directed to a snow guard having a body member that straddles a raised seam portion of a roof to mount the snow guard without piercing the surface of the roof or the seam structure. The body member is formed in two opposing halves and is clamped onto the raised seam by a bolt that passes above the seam to interengage the opposing sides of the body member and effect a clamping action on the seam structure. While the Peter mechanism does not cause a deformation of the raised seam structure of the roof, the clamping action is indirect and does not provide a substantial affixation of the snow guard to the roof structure.

Accordingly, it would be desirable to provide a mounting bracket and associated snow guard therefor that would effectively mount on a raised seam roof structure without causing a deformation of the raised seam portion of the roof.

Furthermore, the raised seam portion of such roofs are formed with different shapes and sizes, which is not contemplated by most of the aforementioned prior art snow guard mounting members. Accordingly, it would be desirable to provide an apparatus for mounting devices to a raised seam roof that would be at least somewhat universal in application to accommodate different sizes and shapes of the raised seam portions.

SUMMARY OF THE INVENTION

It is an object of this invention to overcome the disadvantages of the prior art by providing a bracket for mounting a snow guard on a raised seam roof.

It is another object of this invention to provide a mounting bracket for attaching devices to a raised seam roof structure without deforming the raised seam structure.

It is a feature of this invention that the mounting bracket clamps onto the raised seam portion of a roof structure without deforming or penetrating the structure of the roof.

It is an advantage of this invention that the clamping action of the mounting bracket incorporating the principles of the instant invention is effected through manipulation of a single bolt.

It is another advantage of this invention that the mounting bracket utilizes a pair of opposing clamping jaws to grip the raised seam portion of a roof structure.

It is another feature of this invention that one of the clamping jaws of the mounting bracket is fixed to a body member.

It is still another feature of this invention that a second clamping jaw is movable in conjunction with a threaded bolt to advance toward the fixed clamping jaw to grip a raised seam structure between the two opposing clamping jaws.

It is still another advantage of this invention that the clamping jaws are removable from the body member of the mounting bracket to provide flexibility in accommodating different sizes and shapes of raised seam structures.

It is still another object of this invention to provide a mounting bracket that has a universal nature in accommodating a variety of sizes and shapes of raised seam roof structures.

It is yet another feature of this invention that the body member defines a large cavity within which the clamping jaws operate to provide a wide opening for receiving the raised seam structure.

It is yet another object of this invention that the mounting bracket incorporates a quick attach implement mounting system for receiving devices to be mounted on a raised seam roof.

It is further feature of this invention that the implement mounting system is formed with a wedge-shaped opening and a fastener that locks an implement to the top of the mounting bracket.

It is a still another advantage of this invention that the implement or device to be mounted on top of the mounting bracket can be quickly and easily replaced.

It is a further object of this invention to provide a snow guard device that can be attached to a mounting bracket to retain snow on the surface of an inclined raised roof structure.

It is still a further object of this invention to provide a mounting bracket for mounting devices to the surface of a raised seam roof structure, which is durable in construction, inexpensive of manufacture, carefree of maintenance, facile in assemblage, and simple and effective in use.

These and other objects, features and advantages are accomplished according to the instant invention by providing a mounting bracket for attaching implements and other devices to the top surface of an inclined raised seam roof structure. The mounting bracket is formed with a body portion defining a wide cavity between opposing side walls to accommodate a variety of different sizes and shapes of raised seam configurations. A pair of opposing clamping jaws are disposed within the body cavity. One clamping jaw is fixed to a side of the body member, while the other clamping jaw is movably mounted to a threaded fastener that advances the movable clamping jaw toward the fixed clamping jaw and grip a raised seam structure therebetween. The body portion has a wedge-shaped receptacle on the top surface to mount devices such as a snow guard, which can be locked into place on the mounting bracket by a threaded fastener.

BRIEF DESCRIPTION OF THE DRAWINGS

The advantages of this invention will become apparent upon consideration of the following detailed disclosure of the invention, especially when taken in conjunction with the accompanying drawings wherein:

FIG. 3 is a side elevational view of the mounting bracket of FIG. 1;

FIG. 4 is an enlarged detail view of the actuating fastener associated with the movable clamping jaw, as depicted in FIG. 1;

FIG. 4A is an enlarged detail view of an alternative fastener assembly associated with the movable clamping jaw;

DETAILED DESCRIPTION OF THE PREFERRED EMBODIMENT

Figure 1:
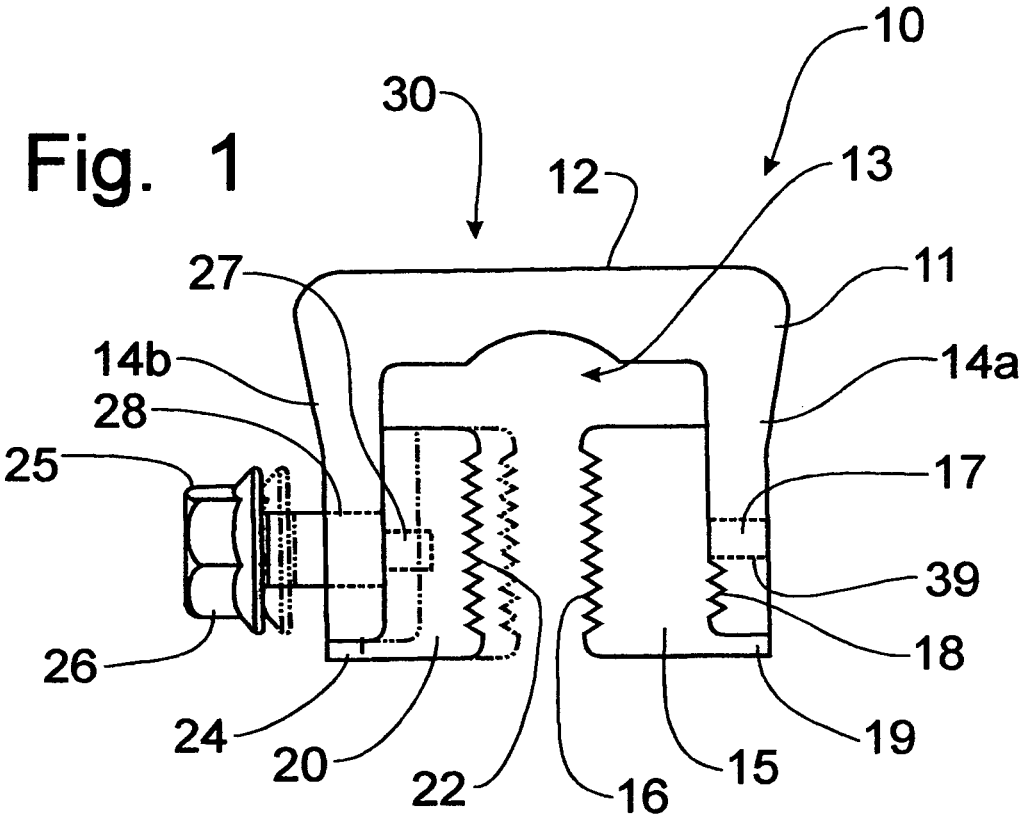
FIG. 1 is a side elevational view of a first embodiment of a mounting bracket incorporating the principles of the instant invention, the movement of the movable clamping jaw and associated fastener being shown in dotted lines.
Figure 2:
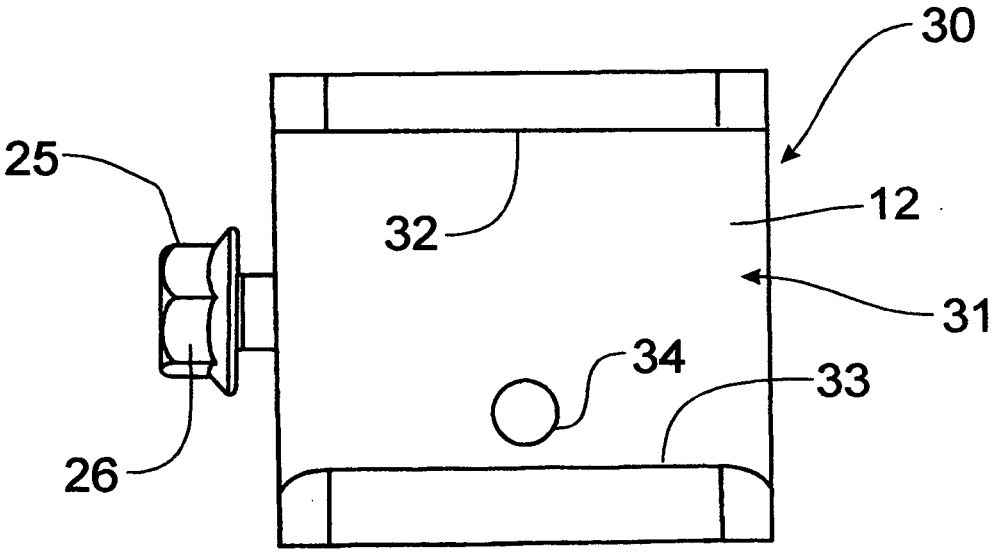
FIG. 2 is a top plan view of the mounting bracket depicted in FIG. 1 showing the wedge-shaped implement mounting receptacle.

Referring now to FIGS. 1–3, a first embodiment of a mounting bracket incorporating the principles of the instant invention can best be seen. In the embodiment of FIGS. 1–3, the mounting bracket 10 has an inverted U-shaped body member 111 that defines a cavity 13 between the two opposing side walls 14*a*, 14*b*. The width and height of the cavity 13 is sufficient to receive substantially all sizes and configurations of raised seam portions of roofs. Supported on the adjacent side walls 14 are clamping jaws 15, 20 that physically engage the raised seam portion (not shown) of the roof to affix the mounting bracket 10 to the roof structure.

The fixed clamping jaw 15 is preferably formed with a serrated gripping surface 16 and is supported in the side wall 14 by a pin member 17 that extends into a hole 39 formed in the side wall 14*a*. In addition, the side wall 14*a* may be formed with a serrated portion 18 that interacts with corresponding serrations on the adjacent side of the fixed clamping jaw 15 to further support the fixed clamping jaw 15 on the body member 11 and restrict generally vertical movement of the fixed clamping jaw 15 relative to the side wall 14*a*, particularly when mounted on a raised roof seam (not shown). One skilled in the art will recognize that the fixed clamping jaw 15 can be sized, particularly with respect to the depth to which the fixed clamping jaw 15 extends into the cavity 13 from the side wall 14*a*, to conform to the specific shape and size of the raised roof seam (not shown) that will be engaged by the fixed clamping jaw 15. Furthermore, the shape of the fixed clamping jaw 15 can be varied to conform to the shape of the raised roof seam to be engaged. The fixed clamping jaw 15 is also preferably formed with a support leg 19 that underlies the side wall 14*a* to further stabilize the position of the fixed clamping jaw 15 on the side wall 14*a*.

On the opposing side wall 14*b*, a movable clamping jaw 20 is mounted. Similar to the fixed clamping jaw 15, the movable clamping jaw 20 is preferably formed with a serrated gripping surface 22 for engagement with the raised roof seam (not shown) to which the mounting bracket 10 is to be affixed. Further like the fixed clamping jaw 15, the movable clamping jaw 20 can be formed in an appropriate size and shape to conform to the configuration of the raised roof seam to be engaged. The movable clamping jaw 20 is also formed with a support leg 24 underlying the side wall 14*b* to provide stabilizing support for the movable clamping jaw 20. The movable clamping jaw 20 is operatively engaged with a threaded fastener 25, best seen in FIG. 4, or alternatively in FIG. 4A, to effect movement relative to the side wall 14*b* toward or away from the fixed clamping jaw 15. The fastener 25 is threaded into a hole 21 formed in the side wall 14*b* to permit translational movement of the fastener 25 within the side wall 14*b*.

Referring now to FIG. 4, the fastener 25 is formed with a smooth surfaced pin portion 27 that projects into an opening 23 in the movable clamping jaw 20. The pin portion 27 has a smaller diameter than the threaded portion 28 of the fastener 25, thus forming a shoulder 29 against which the movable clamping jaw 20 can be engaged by the fastener 25. Therefore, the manipulation of the hex head 26 of the fastener 25 to effect rotation thereof within the threaded opening within the side wall 14*b* will cause translational movement of the fastener 25 through the side wall 14*b* to force the shoulder 29 against the movable clamping jaw 20. This movement will push the movable clamping jaw 20 toward the fixed clamping jaw 15 to trap a raised roof seam (not shown) therebetween, as is depicted in phantom in FIG. 1.

The top surface 12 of the U-shaped body member 11 is formed with an attachment receptacle 30 for mounting implements and/or attachments to the mounting bracket 10. The attachment receptacle 30 is formed as a relief depression 31 into the top surface 12. The depression 31 preferably extends across the entire top surface 12 from side wall 14*a* to side wall 14*b* and has a first generally vertical edge 32 and an inwardly beveled wedging edge 33 opposite to the vertical edge 32. The depression 31 is operable to receive an attachment formed with a correspondingly matched base member, as will be described in greater detail below. An aperture 34 extending vertically through the top surface 12 of the body member 11 will permit a locking fastener 50 to engage the attachment seated within the depression 31 to lock the attachment to the mounting bracket 10, as will also be described in greater detail below.

Figure 5:
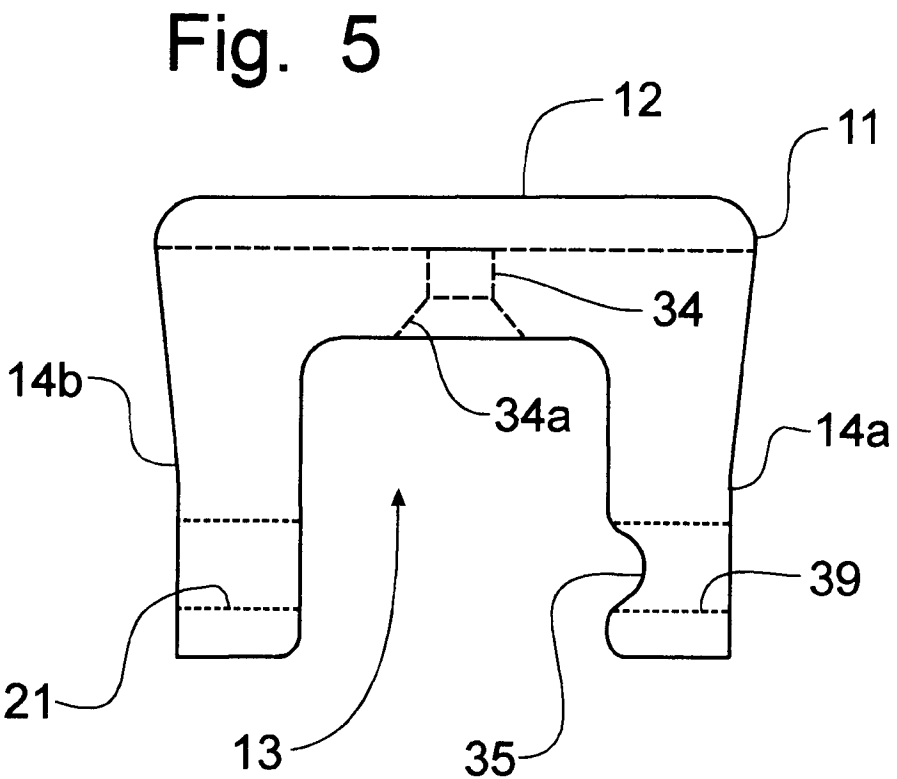
FIG. 5 is a side elevational view of an alternative embodiment of a body member of a mounting bracket incorporating the principles of the instant invention.
Figure 6:
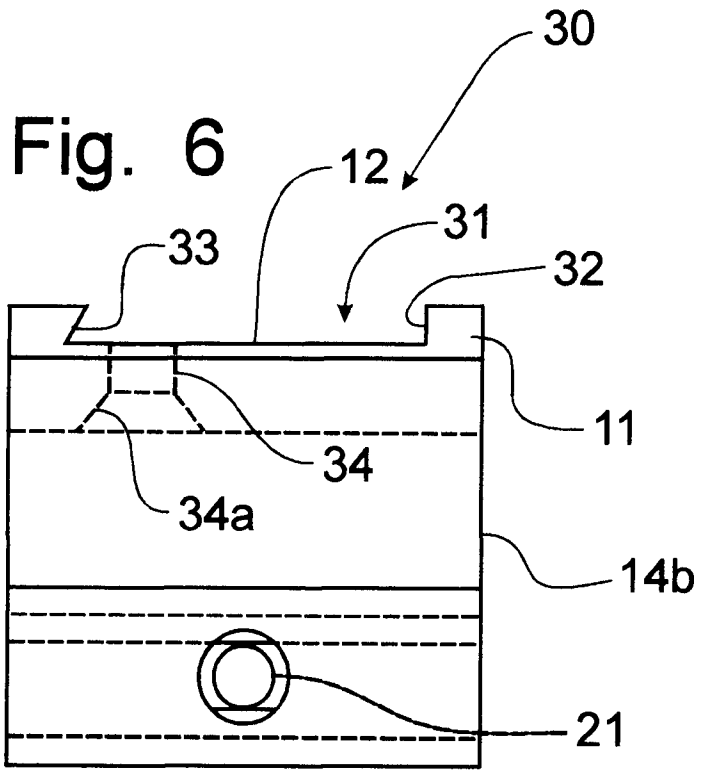
FIG. 6 is a side elevational view of the mounting bracket body member depicted in FIG. 5 taken perpendicularly to the view of FIG. 5.
Figure 7:
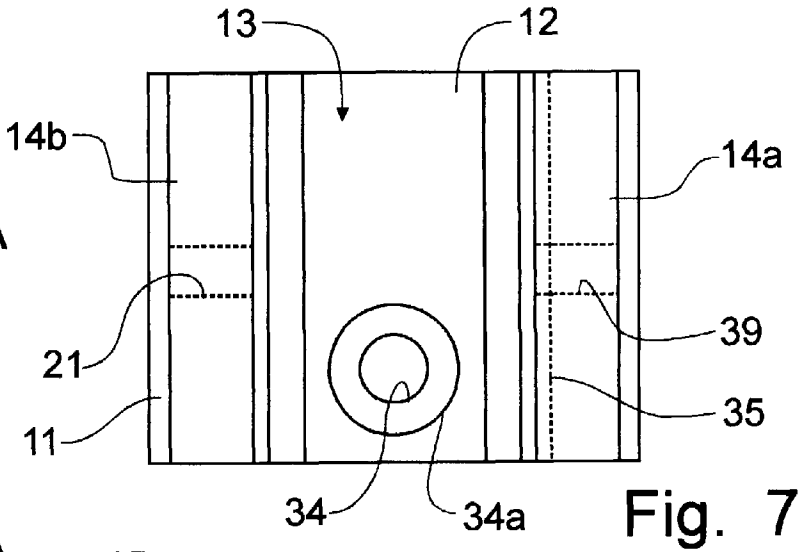
FIG. 7 is a bottom plan view of the mounting bracket body member depicted in FIG. 5.
Figure 8:
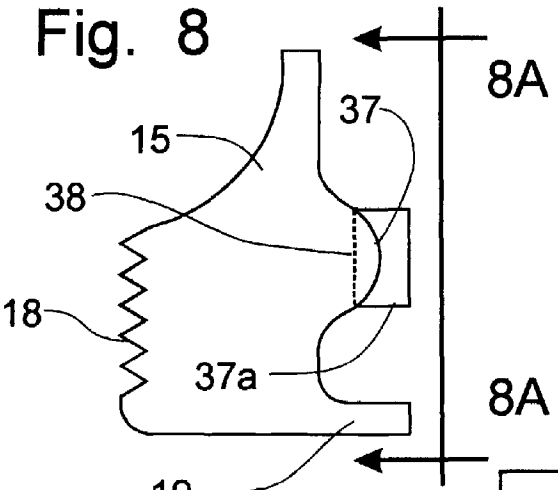
FIG. 8 is an enlarged side elevational view of the fixed clamping jaw for the mounting bracket body member depicted in FIG. 5.
Figure 8A:
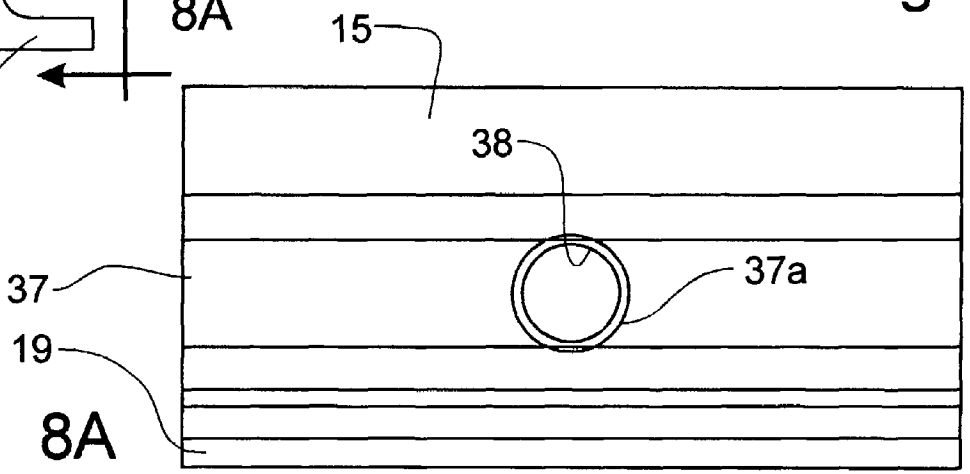
FIG. 8A is an enlarged side elevational view of the fixed clamping jaw corresponding to lines 8A—8A of FIG. 8.

An alternative configuration of the mounting bracket 10 is depicted in FIGS. 5–10. Compared to the configuration described above with respect to FIGS. 1–3, the body member 11 has a slightly different shape. As seen in FIG. 5, the side wall 14*a* corresponding to the fixed clamping jaw 15 is formed with a notch 35 on the interior surface thereof to engage a correspondingly shaped node 37 on the fixed clamping jaw 15, which is depicted in FIGS. 7, 8 and 8A. The interengagement between the node 37 and the notch 35 restricts vertical movement of the fixed clamping jaw 15 relative to the side wall 14*a* to provide stability to the assembled mounting bracket 10. The opening 39 in the side wall 14*a* is preferably aligned with a threaded opening 38 in the fixed clamping jaw 15 so that a set screw (not shown) can engage the fixed clamping jaw 15 for affixation to the body member 11. A receptor 37*a* is formed on the node 37 to engage the threaded opening 38 and receive the set screw (not shown).

The dimensions of the body member 11, i.e. the thicknesses of the top surface 12 and the side walls 14*a*, 14*b*, are greater than in the configuration depicted in FIGS. 1–3 to provide greater strength in mounting attachments to the receptacle 30 on the top surface 12 and to resist deformation of the body member 11 when placing a clamping load on the clamping jaws 15, 20 to affix the mounting bracket 10 to a raised roof seam (not shown). The aperture 34 can be formed with a countersink relief 34*a* defining a shoulder against which the fastener 50 can lock the attachment to the receptacle 30. The relief 34*a* can be shaped and sized deep enough to countersink the head of the locking fastener 50 within the body member 11 so that the head would not protrude into the cavity 13 formed by the body member 11 and interfere with the reception of the raised roof seam.

Both the fixed and movable clamping jaws 15, 20 depicted in FIGS. 7–10 reflect the differences in shape and/or size of the clamping jaws 15, 20 that can be provided to accommodate different raised seam configurations. The upper portion of the structure of both the fixed and movable clamping jaws 15, 20 have been eliminated with a arcuate surface that will deflect moisture downwardly to the surface of the roof. The elimination of this part of the clamping jaws 15, 20, as compared with the shape of the clamping jaws 15, 20 depicted in FIG. 1, permits an even greater range of raised seam configurations to be accommodated within the cavity 13. Still other sizes and shapes of the clamping jaws 15, 20 are within the scope of the instant invention.

Figure 9:
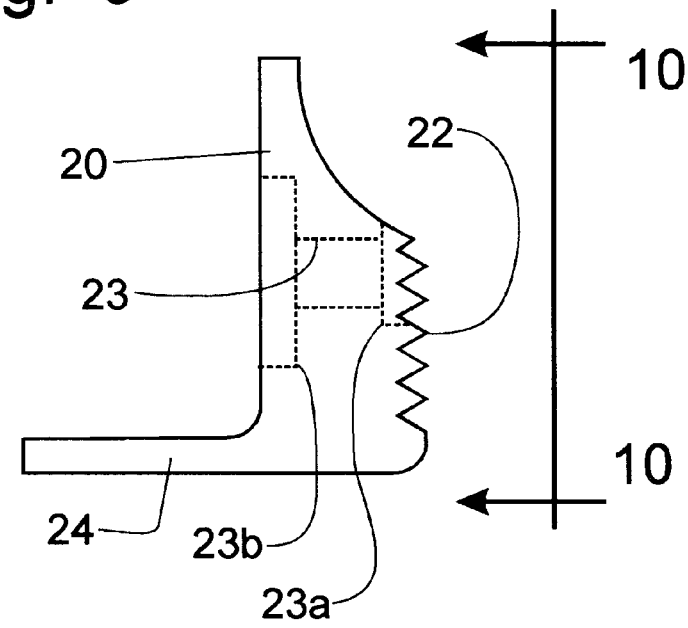
FIG. 9 is an enlarged side elevational view of the movable clamping jaw for the mounting bracket body member depicted in FIG. 5.
Figure 10:
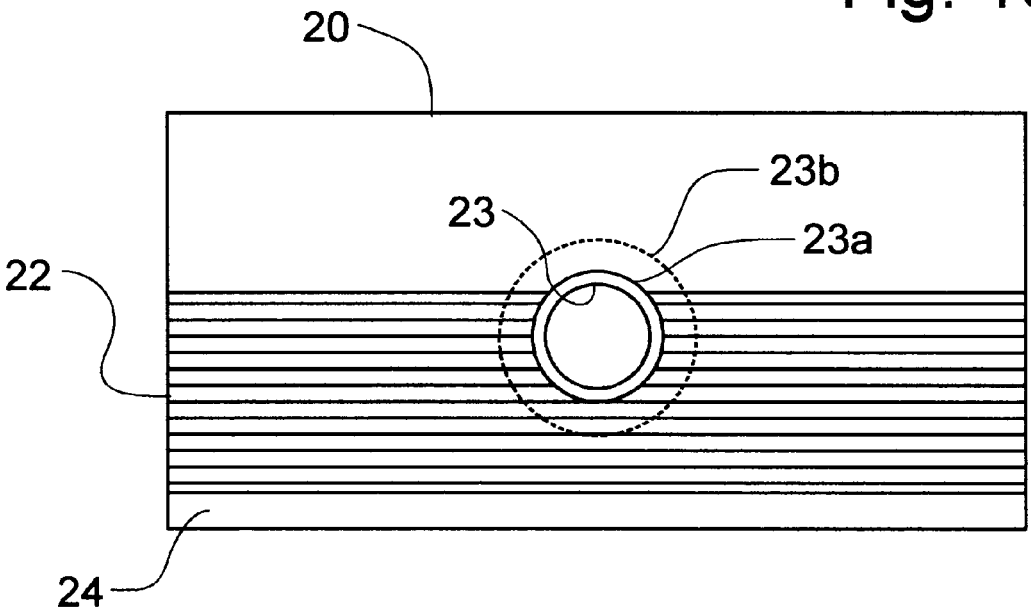
FIG. 10 is an enlarged side elevational view of the movable clamping jaw corresponding to lines 10—10 of FIG. 9.
Figure 11:
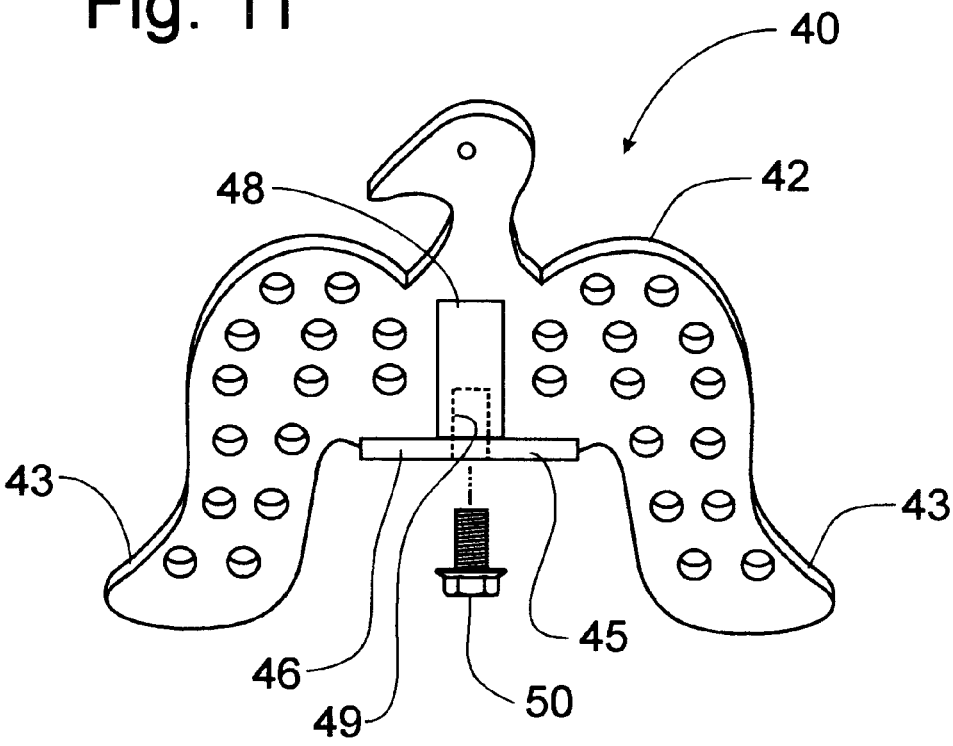
FIG. 11 is an elevational view of the snow guard attachment for mounting in the mounting receptacle of the mounting bracket.
Figure 12:
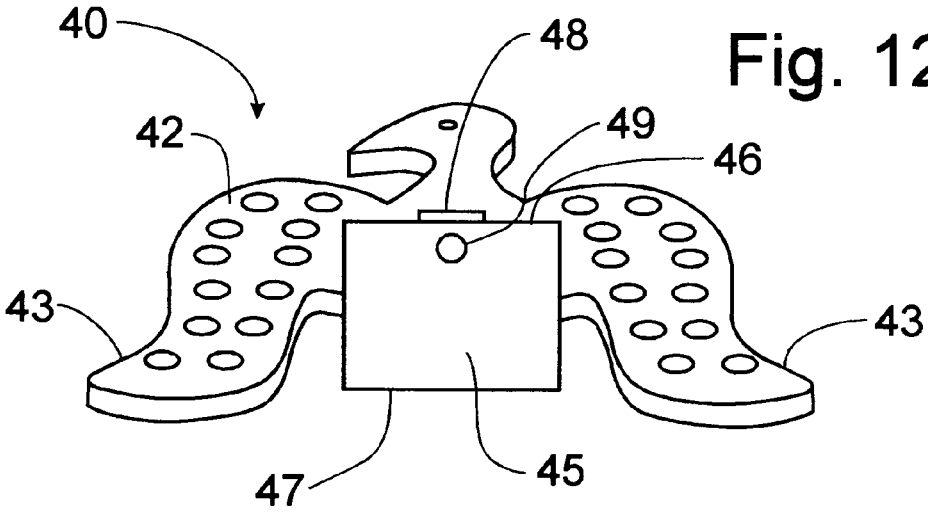
FIG. 12 is a bottom plan view of the snow guard attachment of FIG. 11.

The movable clamping jaw 20 is best seen in FIGS. 9 and 10. The opening 23 passing through the movable clamping jaw 20 is sized to receive a fastener assembly 60, which is best seen in FIG. 4A. The opening 23 is not threaded and has a first countersink relief opening 23*a* to receive the head 62 of the fastener 61, as will be described in greater detail below. The movable jaw 20 is also preferably formed with a receiving shoulder 23*b* that can be depressed into the body of the movable clamping jaw 20 and positioned concentric with the opening 23. This configuration of the opening 23 conforms with the configuration of the alternative fastener assembly 60 shown in FIG. 4A.

The fastener assembly 60 shown in FIG. 4A has a threaded member 65 that engages the threaded hole 21 in the side wall 14*b* and projects into and engages the receiving shoulder 23*b* in the movable clamping jaw 20. The threaded member has a hex depression 66 to receive an Allen wrench or other similar tool to effect rotation of the threaded portion 65. The fastener 61 is engagable with a threaded opening 67 in the opposing end of the threaded member from the hex depression 66. The head 62 of the fastener 61 is received in the countersink relief 23*a* to lock the movable clamping jaw 20 to the threaded member 65. Since the fastener 61 is not threadably engaged with the movable clamping jaw 20, the rotation of the fastener assembly 60 to effect a translational movement of the threaded member 65 relative to the side wall 14*b* will not cause a corresponding rotation of the movable clamping jaw 20, particularly since the support leg 24 is positioned beneath the side wall 14*b*.

To effect movement of the movable clamping jaw 20, the tool is inserted into the hex depression 66 to effect rotation of the threaded member 65. The threaded member 65 pushes against the receiving shoulder 23*b* to move the movable clamping jaw 20 toward the fixed clamping jaw 15 until the raised seam of the roof (not shown) is firmly engaged between the two clamping jaws 15, 20. To release the movable clamping jaw 20 from the raised seam of the roof, the tool is inserted into the hex depression 66 to rotate the threaded member 65 in the opposite direction. Since the head 62 of the fastener 61 clamps the movable clamping jaw 20 onto the threaded member 65 by the engagement with the countersink relief 23*a*, the movable clamping jaw 20 will be retracted back toward the side wall 14*b*.

A representative attachment in the form of a snow guard 40 can be seen in FIGS. 11–14. The snow guard 40 is formed in a transversely extending body 42 having a shape that extends laterally of the mounting bracket 10 and projects downwardly to come into close proximity or into engagement with the flat surface (not shown) of the roof panel to either side of the mounting bracket 10 to which the snow guard 40 is to be mounted. In the configuration depicted in FIGS. 11–17, the transversely extending body 42 of the snow guard 40 is shaped like a bird whose wings 43 extend downwardly, as will be described in greater detail below. The body 42 is integrally formed with a base member 45 that is configured to be received within the receptacle 30 on the top surface 11 of the mounting bracket 10. The base member 45 is formed with a first generally perpendicular edge 46 that corresponds to the vertical edge 32 of the receptacle depression 31 on the top surface 12 of the body member 11, and with a beveled edge 47 that corresponds to the wedging edge 33.

Figure 13:
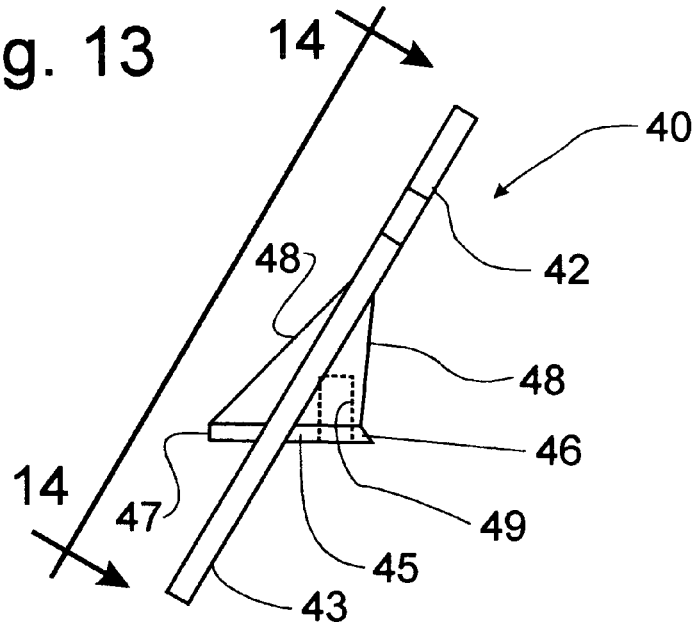
FIG. 13 is a side elevational view of the snow guard attachment orthogonal to the view of FIG. 11 and corresponding to lines 13—13 of FIG. 14.
Figure 14:
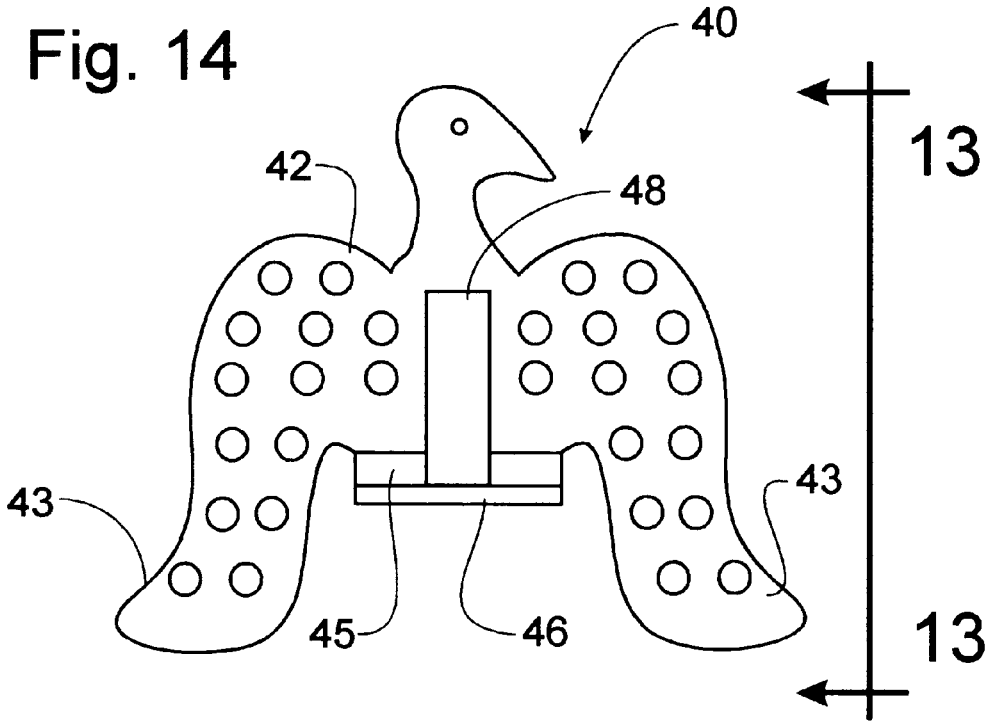
FIG. 14 is a rear elevational view of the snow guard attachment looking perpendicularly to the body portion of the attachment, corresponding to lines 14—14 of FIG. 13.

The body 42 is angled preferably at about 60 degrees to the base member 45, as is best seen in FIG. 13, to orient the body 42 in a more perpendicular orientation with respect to the plane of the roof when attached to a mounting bracket 10 affixed to a raised roof seam. If, for example, the roof was pitched at a 30 degree angle, the body 42 would then be literally perpendicular to the plane of the roof to provide resistance to the movement of snow downwardly over the surface of the roof. To resist the bending forces that are exerted on the body 42 of the snow guard 40, integral braces 48 extend fore-and-aft between the body 42 and the base member 45. The brace 48 on the uphill side of the snow guard 40 will receive a threaded passage 49 that is alignable with the aperture 34 in the top surface 12 of the body member 11 to permit engagement with the locking fastener 50 that fixes the attachment 40 to the body member 11.

One skilled in the art will readily recognize that many different attachments can be formed with a base member 45 that can be received by the attachment receptacle 30. Snow guards 40 can be formed in many different shapes and sizes for mounting on the mounting bracket 10. A snow fence (not shown), which would be equipped with a plurality of base members 45 that would be received with a corresponding number of mounting brackets 10 mounted generally parallel to the peak of the roof structure, would be an alternative example of a snow guard. Other attachments can be antennas, display signs, air conditioning units, ladders and walk ways. All such configured attachments can be quickly and easily attached to the mounting bracket by receiving the base member into the attachment receptacle 30 and connecting the locking fastener 50 to fix the base member 45 to the top surface 12 of the body member 11.

Figures 15, 16, 17:
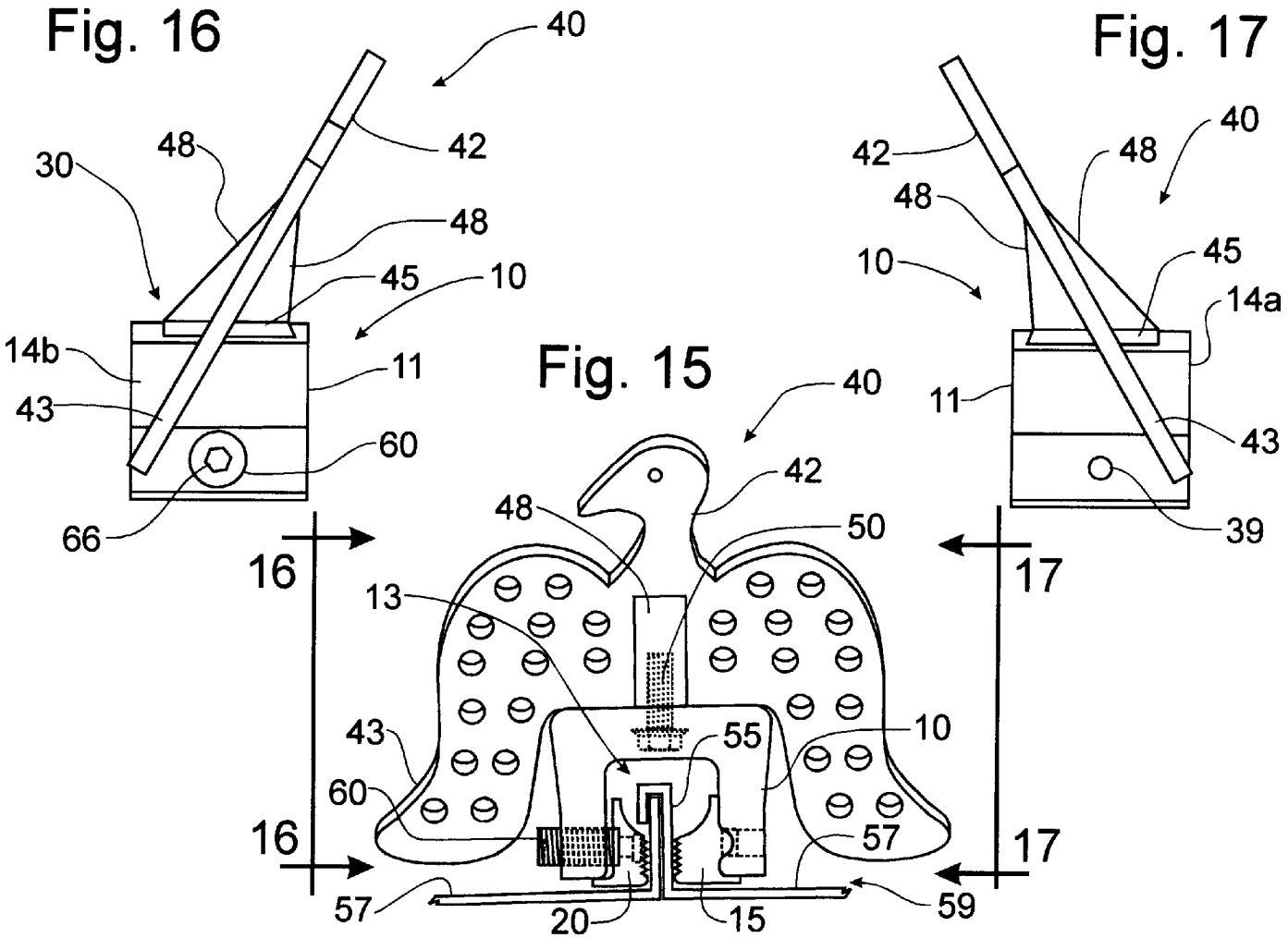
FIG. 15 is an elevational view of the alternative embodiment of the mounting bracket assembly with the snow guard attachment mounted thereon, the fastener assembly of FIG. 4A being used to mount and adjustably move the movable clamping jaw.
FIG. 16 is a side elevational view of the mounting bracket assembly perpendicular to the view of FIG. 15 and corresponding to lines 16—16 of FIG. 15.
FIG. 17 is a side elevational view of the mounting bracket assembly opposite to that of FIG. 16 and corresponding to lines 17—17 of FIG. 15.

Referring now to FIGS. 15–17, an assembled snow guard 40 on a mounting bracket 10 can best be seen. The mounting bracket 10 is of the configuration depicted in FIGS. 5–10, utilizing the fastener assembly 60 of FIG. 4A, and is mounted on a representative raised seam portion 55 of a roof structure that projects vertically above the flat surface 57 of the roof panels 59. The snow guard 40 is mounted in the attachment receptacle 30 with the wings 43 extending downwardly to a position just above the flat surface 57. The transversely extending body 42 of the snow guard 40 presents a barrier to the movement of snow over the flat surface 57 of the roof panel 59.

The snow guard 40 is attached to the mounting bracket 10 by slipping the base member 45 into the depression 31 on the top surface 12 of the body member 11 of the mounting bracket 10 with the beveled edge 47 positioned underneath the wedging edge 33. The locking fastener 50 is then inserted from within the cavity 13 through the aperture 34 into the threaded passage 49 in the base member 45 of the snow guard 40, thus fixing the base member 45 to the top surface 12 of the body member 11. One skilled in the art will readily recognize that a different form of attachment could utilize a locking fastener 50 that is inserted through the attachment from above the mounting bracket 10 and engaged into the aperture 34 which would be threaded to engage the locking fastener 50. In such a configuration, however, the locking fastener 50 would not be protected from beneath the top surface 12 of the body member 11.

The mounting bracket 10 with the snow guard 40 mounted thereon is then positioned over top of the raised seam portion 55 with the fixed clamping jaw 15 on one side of the raised seam 55 and the movable clamping jaw 20 on the opposing side of the raised seam 55. The threaded fastener assembly 60, which is threadably received in the side wall 14*b*, is then rotated to push the movable jaw 20 inwardly toward the raised seam 55 until the raised seam 55 is firmly clamped between the two opposing clamping jaws 15, 20, thus fixing the mounting bracket 10 and attachment 40 on the raised seam 55 with the manipulation of only a single fastener assembly 60. The clamping forces asserted by the movable clamping jaw 20 manipulated through the single fastener assembly 60 are spread across the entire length of the clamping jaws 15, 20 to prevent tipping or other movement of the mounting bracket 10 relative to the raised seam 55.

To remove the mounting bracket 10 from the raised seam 55, or to detach the snow guard 40 of the configuration shown in FIGS. 15–17, the fastener assembly 60 is manipulated to withdraw from the side wall 14*b*, thus drawing the movable clamping jaw 20 by the fastener 61 away from the raised seam and releasing the clamping forces exerted on the raised seam 55, until the movable clamping jaw 20 can be disengaged from the raised seam 55. The mounting bracket 10 can then be removed from the raised seam 55 so that the locking fastener 50 can be accessed. A removal of the locking fastener 50 will permit the snow guard attachment 40 to be released from the attachment receptacle, thus permitting the installation of another attachment or the replacement of the snow guard 40.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

What is claimed is:

1. A mounting bracket for attachment to a raised roof seam comprising:

a body member having first and second opposing side walls and a top surface spanning between said side walls to define a cavity therebetween for receiving said raised roof seam between said side walls;

a first removable clamping jaw supported to said first side wall, said first clamping jaw being fixed with respect to translational movement relative to said first side wall and having a substantially planar seam-engaging surface;

a second removable clamping jaw supported on said second side wall for selective translational movement toward and away from said first clamping jaw, said second clamping jaw having a substantially planar seam-engaging surface; and an actuator operatively associated with said second clamping jaw for affecting said translational movement thereof and exerting a clamping force on said raised roof seam to clamp said raised roof seam between said first and second clamping jaws, said substantially planar seam-engaging surfaces on said first and second clamping jaws permitting an engagement of said raised roof seam without substantial deformation thereof irrespective of the amount of said clamping force exerted on said raised roof seam.

2. The mounting bracket of claim 1 wherein said clamping jaws are formed with serrated gripping surfaces engagable with said raised roof seam.

3. The mounting bracket of claim 1 wherein said first clamping jaw is fixed to said first side wall.

4. The mounting bracket of claim 3 wherein said first clamping jaw is detachably connected to said first side wall to permit removal thereof.

5. The mounting bracket of claim 4 wherein said actuator is a threaded member threadably received in said second side wall.

6. The mounting bracket of claim 5 wherein said threaded member has a threaded portion threadably engaged with an opening in said second side wall and a threaded fastener engaged with said threaded member to mount said second clamping jaw to said threaded member.

7. The mounting bracket of claim 1 wherein said top surface is formed with an attachment receptacle for connecting a device to said body member.

8. The mounting bracket of claim 7 wherein said attachment receptacle is formed as a depression in said top surface, said depression having a wedging edge beneath which said device can be trapped for retention in said depression.

9. The mounting bracket of claim 8 wherein said top surface has a generally vertical opening therethrough to receive a locking fastener for engaging said device within said depression.

10. In a mounting bracket for attachment to a raised roof seam, said mounting bracket having a body member including first and second opposing side walls and a top surface spanning between said side walls to define a cavity therebetween for receiving said raised roof seam between said side walls, the improvement comprising:

a pair of removable clamping jaws supported respectively on said opposing side walls for translational movement relative to the corresponding said side wall to engage said raised roof seam therebetween, said removable clamping jaws being positioned in register with one another to grip said raised roof seam therebetween, each said removable clamping jaw having a substantially planar seam-engaging surface to permit said raised room seam to be subjected to an equally distributed clamping force without deforming said raised roof seam irrespective of the amount of clamping force exerted by said removable inserts on said raised roof seam; and an actuator operatively associated with one of said movable clamping jaws for effecting said translational movement thereof.

11. The mounting bracket of claim 10 wherein said removable insert has a shape facilitating engagement with said raised roof seam.

12. The mounting bracket of claim 10 wherein said top surface is formed with an attachment receptacle for connecting a device to said body member.

13. The mounting bracket of claim 12 wherein said attachment receptacle is formed as a depression in said top surface, said depression having a wedging edge beneath which said device can be trapped for retention in said depression.

14. The mounting bracket of claim 13 wherein said top surface has a generally vertical opening therethrough to receive a locking fastener for engaging said device within said depression.

15. In a mounting bracket for attachment to a raised roof seam, said mounting bracket having a body member including first and second opposing side walls and a top surface spanning between said side walls to define a cavity therebetween for receiving said raised roof seam between said side walls, the improvement comprising:

a removable clamping jaw supported on said first side wall for translational movement relative to said first side wall; and an actuator operatively associated with said removable clamping jaw for effecting said translational movement thereof, said top surface being formed with an attachment receptacle for connecting a snow retention device to said body member, said attachment receptacle being formed as an open depression in said top surface, said depression having a single wedging edge formed along one side thereof beneath which said device can be trapped for retention in said depression, said top surface having formed therein a generally vertical opening extending therethrough from said cavity to receive a locking fastener therethrough for engaging said snow retention device within said depression to affix said snow retention device to said mounting bracket, access to said locking fastener being available only through said cavity.

16. The mounting bracket of claim 15 further comprising:

a second removable clamping jaw supported on a said second side wall, said raised roof seam being clamped between said first and second removable clamping jaws.

17. The mounting bracket of claim 16 wherein said second removable clamping jaw is positionally fixed on said second side wall for engaging said raised roof seam.

18. The mounting bracket of claim 17 wherein said first and second removable clamping jaws are formed with serrated surfaces engagable with said raised roof seam.

19. A snow guard assembly for mounting on a raised seam roof having an upwardly projecting raised seam portion to restrict movement of snow over the top of said raised seam roof, comprising:

a mounting bracket including:

a body member having first and second opposing side walls and a top surface spanning between said side walls to define a cavity therebetween for receiving said raised roof seam between said side walls;

a first clamping jaw supported to said first side wall;

a second clamping jaw supported on said second side wall for translational movement relative to said first clamping jaw;

an actuator operatively associated with said second clamping jaw for effecting said translational movement thereof, said raised roof seam being clamped between said first and second clamping jaws; and an attachment receptacle on said top surface of said body member; and a snow guard member including:

a base member having a configuration for reception in said attachment receptacle;

a transversely extending body portion including downwardly depending members extending adjacent said side walls of said mounting bracket; and a locking member for securing said base member to said attachment receptacle.

20. The snow guard assembly of claim 19 wherein said attachment receptacle is formed as a depression in said top surface, said depression having a wedging edge beneath which said device can be trapped for retention in said depression, said base member having a beveled edge corresponding to said wedging edge.

21. The snow guard assembly of claim 20 wherein said locking member is a fastener received through a generally vertical opening through said top surface to permit said locking fastener to interengage said base member and said top surface.

22. The snow guard assembly of claim 21 wherein said first clamping jaw is detachably connected to and positionally fixed to said first side wall.

* * * * *